US006880766B2

(12) United States Patent
Lewis et al.

(10) Patent No.: US 6,880,766 B2
(45) Date of Patent: Apr. 19, 2005

(54) LEAK ARREST VOLUME FOR REDUCING COMPONENT SEPARATION AND FUEL INJECTOR USING SAME

(75) Inventors: Stephen Robert Lewis, Minonk, IL (US); David Balke, Morton Grove, IL (US); Gene Ray Slinkard, Pontiac, IL (US)

(73) Assignee: Caterpillar Inc, Peoria, IL (US)

( * ) Notice: Subject to any disclaimer, the term of this patent is extended or adjusted under 35 U.S.C. 154(b) by 81 days.

(21) Appl. No.: 10/377,331

(22) Filed: Feb. 28, 2003

(65) Prior Publication Data

US 2004/0195348 A1 Oct. 7, 2004

(51) Int. Cl.[7] ..... F02M 47/02; F02M 59/00; F02M 61/00; F02M 63/00; B05B 9/00

(52) U.S. Cl. ..... 239/88; 239/124; 239/533.2; 239/585.1

(58) Field of Search ..... 239/88, 124, 533.2, 239/585.1, 89, 90, 91, 92, 585.2, 585.3, 585.4, 585.5, 533.3, 533.9, 127; 251/129.07; 123/506, 514, 447

(56) References Cited

U.S. PATENT DOCUMENTS 5,474,234 A * 12/1995 Maley ..... 239/88
5,803,369 A * 9/1998 Toyao et al. ..... 239/533.8
5,897,058 A 4/1999 Coldren et al.
5,901,686 A 5/1999 Stockner et al.
5,992,768 A 11/1999 Beatty et al.
6,260,776 B1 * 7/2001 Popp ..... 239/533.6
6,666,390 B1 * 12/2003 Itou ..... 239/600

* cited by examiner

*Primary Examiner*—David A. Scherbel
*Assistant Examiner*—Darren Gorman
(74) *Attorney, Agent, or Firm*—Liell & McNeil

(57) ABSTRACT

Particularly in the fuel injector art, two components may define a high pressure space that is sealed against leakage via a planar sealing land between the two components. If a leak develops in the planar contact area between the two components, it can act to wedge the two components apart, which tends to exacerbate the leakage problem, and so on. Since some leakage between the two components is almost inevitable for a variety of reasons known in the art, a strategy that arrests the leak before it can produce the component separating wedge affect would be beneficial. This can be accomplished by positioning a leak arrest volume, which may be vented, around a majority of the perimeter of the high pressure space. The usage of a leak arrest volume finds particular application in fuel injectors, especially a class of common rail fuel injectors that are maintained at high pressure during prolonged periods between injection events.

15 Claims, 3 Drawing Sheets

LEAK ARREST VOLUME FOR REDUCING COMPONENT SEPARATION AND FUEL INJECTOR USING SAME

TECHNICAL FIELD

The present invention relates generally to limiting leakage between components that define a high pressure space, and more particularly to implementation of a leak arrest volume around a planar sealing land between two components.

BACKGROUND

In many devices, such as fuel injectors, a plurality of components are positioned in contact with one another to define a high pressure space. These components are clamped together in an effort to prevent leakage through the planar sealing land between the components. In the case of fuel injectors, these components can be charged with sealing against leakage in the face of relatively high pressures, which can be on the order of 200 MPa or greater. Engineers have observed that when a leak develops between adjacent components, at such high pressures, it can sometimes act as a wedge to separate the two components creating an even larger leak path. In other words, as the leak penetrates the sealing land between the components, it remains at a relatively high pressure pushing the two components apart, which creates an even larger leak area. This action can cause even further component separation, resulting in even more leakage.

In the case of fuel injectors, this type of leakage is undesirable for several reasons. First, any leaked fuel that was at one time pressurized, arguably results in a waste of energy, since the fuel was pressurized from engine power but not injected into the same. In addition, leakage can undermine the ability to accurately predict the performance of a fuel injector. For instance, if fuel is being leaked that was expected to be injected, the fuel injector may be injecting less fuel than it should. In some fuel injectors, leakage can also reduce injection pressure. In addition, leakage can be a source of variable performance among a plurality of fuel injectors in a given engine. For instance, if each fuel injector exhibits substantially different leakage rates, that can cause differing fuel injector performance. In other words, the plurality of fuel injectors could be injecting different amounts of fuel based upon an identical set of control signals.

One previous strategy for dealing with sealing against leakage between fuel injector components with a planar interface, is to reduce the area of the planar surface so that more of the clamping load is concentrated in a smaller area. This strategy, for instance, is illustrated in co-owned U.S. Pat. No. 5,897,058, invented by Coldren et al. While such a strategy can be effective in many applications, other factors, such as spatial limitation features, can reduce the applicability of such a strategy. For instance, in some situations there may be so many fluid passageways, dow alignment bores and/or fastener bores that an implementation of a reduced sealing land area strategy can cause other undesirable effects, such as component distortion that may lead to even more leakage.

The present invention is directed to one or more of the problems set forth above.

SUMMARY OF THE INVENTION

In one aspect, a component sub-assembly includes a first component with a planar surface in contact with a planar surface of a second component. The first and second components define a high pressure space that passes through the planar surfaces at a perimeter. The first and second component define at least one leak arrest volume that is distributed to surround at least a majority of the perimeter.

In another aspect, a fuel injector includes a plurality of stacked components that include a first component and a second component in contact with one another in a plane. The first and second components define high pressure space that passes through the plane at a perimeter. The first and second components define at least one leak arrest volume that is distributed to surround at least a majority of the perimeter.

In still another aspect, a method of limiting leakage between components includes a step of placing a planar surface of a first component in contact with a planar surface of the second component to define a high pressure space with a perimeter. At least one leak arrest volume is defined between the first and second components. The leak arrest volume is distributed to surround at least a majority of the perimeter.

DETAILED DESCRIPTION

Figure 1:
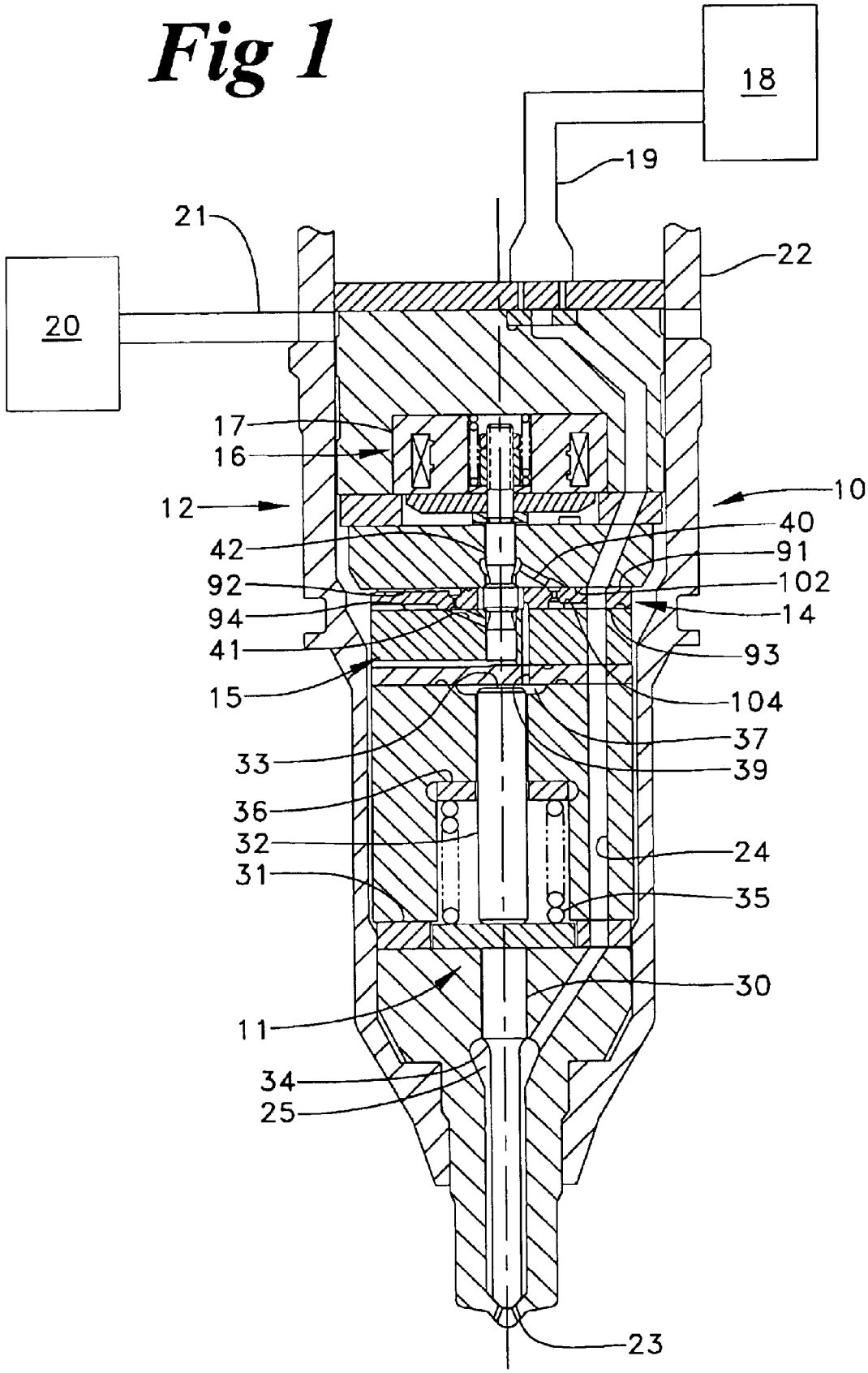
FIG. 1 is a sectioned side diagrammatic view of the fuel injector according to one aspect of the present invention.

Referring to FIG. 1, a fuel injector 10 includes a direct control needle valve 11 that is operably coupled to an electro-hydraulic actuator 12. Electro-hydraulic actuator 12 includes a three way valve 14 that is operably coupled to an electrical actuator 16. Fuel injector 10 is connected to a source of high pressure fuel 18 via a fuel supply line 19, and connected to a low pressure fuel reservoir 20 via a fuel transfer passage 21. Those skilled in the art will recognize that the source of high pressure fuel 18 can come from a common rail, a fuel pressurization chamber within a unit injector or any other means known in the art for pressurizing fuel to injection levels. In addition, the injector body 22 includes at least one nozzle outlet 23.

Within fuel injector 10, fuel arriving from high pressure fuel source 18 travels through an unobstructed nozzle supply passage 24 to arrive at a nozzle chamber 25, which is shown blocked from fluid communication with nozzle outlet 23 by a needle portion 30 of direct control needle valve 11. Needle portion 30 includes an opening hydraulic surface 34 exposed to fluid pressure in nozzle chamber 25. Direct control needle valve 11 is normally biased downward to its closed position, as shown, by the action of a biasing spring 35 acting on a lift spacer 31, which is in contact with a top surface of needle portion 30. Direct control needle valve 11 also includes a piston portion 32 with a closing hydraulic surface 33 exposed to fluid pressure in a needle control chamber 37 and needle control passage 39. Opening hydraulic surface 34 is in opposition to closing hydraulic surface 33. When three way valve 14 is in a first position, needle control chamber 37 is fluidly connected to source of high pressure fuel 18 via needle control passage 39 and a high pressure passage 40 that connects at one end into nozzle supply passage 24.

When valve 14 is at its second position, needle control chamber 37 is fluidly connected to low pressure reservoir 20 via needle control passage 39 and a low pressure passage 41. Three way valve 14 is moved between its first position and its second position by energizing and deenergizing electrical actuator 16. When high pressure exists in needle control chamber 37, direct control needle valve 11 will stay in, or move toward, its downward closed position, as shown. When needle control chamber 37 is connected to low pressure, direct control needle valve 11 will lift to its upward open position if fuel pressure acting on opening hydraulic surface 34 is above a valve opening pressure, which is preferably determined by a biaser, such as the preload of biasing spring 35. In practice, the valve opening pressure of direct control needle valve 11 is adjusted by choosing a VOP spacer 36 of an appropriate thickness. In addition, the lift distance of direct control needle valve 11 is controlled by choosing an appropriate thickness for lift spacer 31. Those skilled in the art will appreciate that in the disclosed embodiment, needle control chamber 37 is a closed volume.

Figure 2:
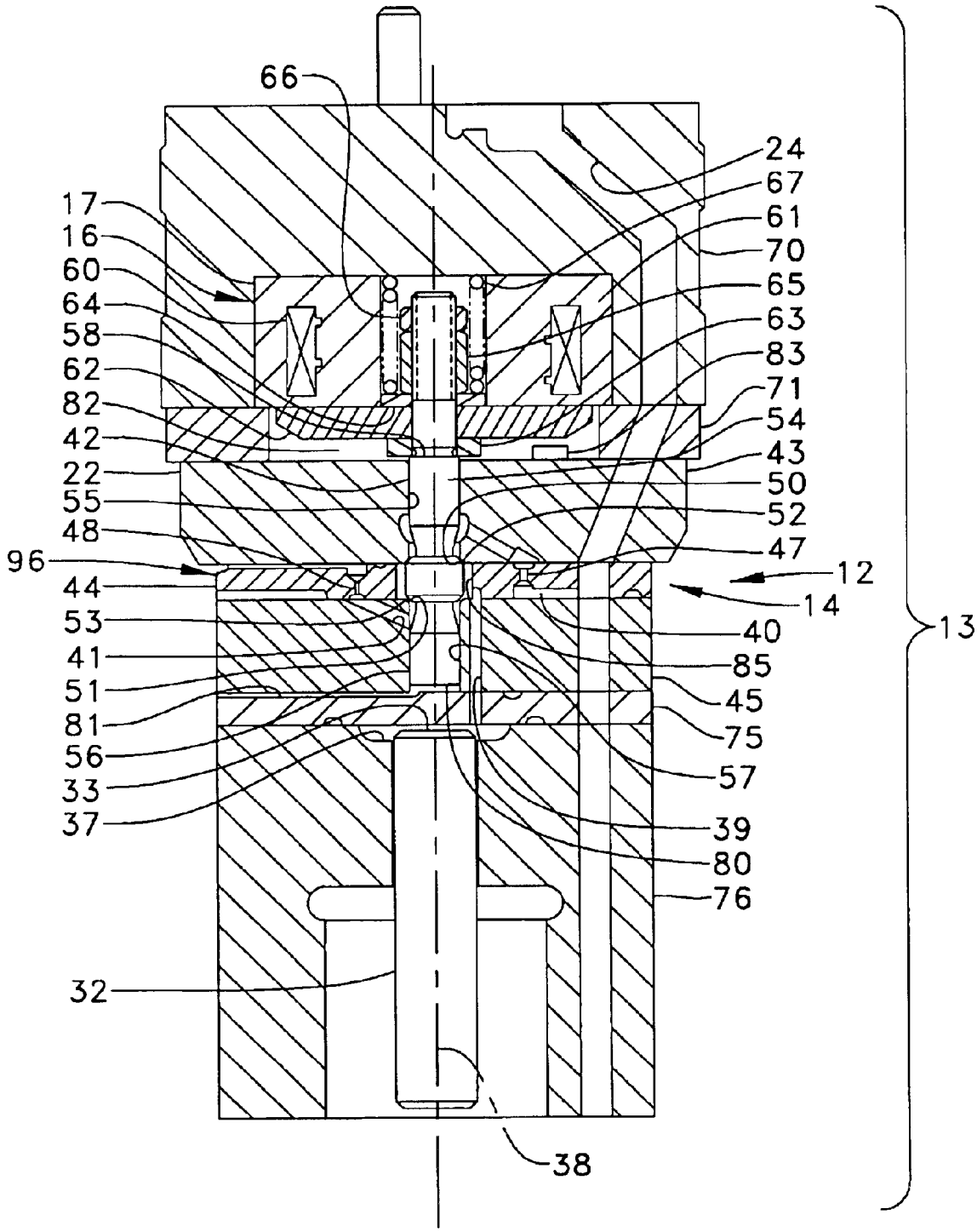
FIG. 2 is a sectioned side diagrammatic view of an electro-hydraulic actuator portion of the fuel injector shown in FIG. 1.

Referring to FIG. 2, electro-hydraulic actuator 12 is shown apart from the fuel injector of FIG. 1. Three way control valve 14 is preferably positioned in close proximity to piston portion 32 so that the volume of needle control chamber 37 is made relatively small. Those skilled in the art will appreciate that pressure changes in needle control chamber 37 can be hastened by reducing its volume. This issue is addressed by actuator 12 in at least two ways. First, three way valve 14 is positioned in close proximity to the closing hydraulic surface 33 of piston portion 32. In addition, needle control chamber 37 is preferably designed to be defined at least in part by volume reducing surface features. Thus, those skilled in the art will recognize that some measurable amount of improved performance can be achieved by paying attention to what surface features which define needle control chamber, can be changed in order to reduce the volume of needle control chamber 37 without otherwise undermining performance. In many instances, it will be desirable to make any flow areas associated with needle control chamber 37 less restrictive than the flow areas associated with high pressure passage 40, low pressure passage 41, or the flow areas across seats 50 and 51. When valve member 42 is in contact with lower seat 51, as shown, needle control chamber 37 is fluidly connected across high pressure seat 50 to nozzle supply passage 24 via high pressure passage 40. When valve member 42 is lifted upward into contact with high pressure seat 50, needle control chamber 37 is fluidly connected to a low pressure area that surrounds actuator 12 across low pressure seat 51 via low pressure passage 41. Thus, valve member 42 can be thought of as being trapped between upper seat 50 and lower seat 51. Seats 50 and 51 can also be referred to as first and second seats, or vice versa. In order to reduce the influence of hydraulic forces on opposite ends of valve member 42, a vent passage 83 vents armature cavity 82 to low pressure, and a vent passage 81 connects vented chamber 80 to low pressure.

Although piston 32 could be located in a common body as lower seat component 45, it is preferably separated from the same by a relatively thin stop plate 75 and housed in its own piston guide body 76, as shown in FIGS. 1 and 2. Leak arrest volume(s) and vent paths could also be used to limit leakage between lower seat component 45, stop plate 75 and guide body 76. In such a case, needle control chamber 37 would be the high pressure space of the claims.

Valve member 42 is preferably operably coupled in a known manner to the moveable portion of an electrical actuator. In the illustrated embodiment, valve member 42 is attached to an armature 62 via a nut 66 that is threaded onto one end of valve member 42. In particular, an armature washer 63 rests upon an annular shoulder 58, upon which armature 62 is supported. Next, a nut washer 64 is placed in contact with the other side of armature 62 followed by a spacer 65, against which nut 66 bears. Armature 62 and hence valve member 42 are biased downward to close low pressure seat 51 by a suitable biaser, such as biasing spring 67. Those skilled in the art will appreciate that a hydraulically biaser could be an alternative to the mechanical bias shown. In addition, while electrical actuator 16 has been shown as a solenoid, those skilled in the art will appreciate that any other suitable electrical actuator, such as a piezo (disks and/or a bender) or a voice coil could be substituted in its place. A stator assembly 17 includes a stator 61, a coil 60 and preferably includes a female/male electrical socket connector to better facilitate bringing electrical energy to actuator 16 via conductors (not shown) penetrating down through injector body 22. Stator assembly 17 is preferably positioned within a carrier assembly 70 such that their respective bottom surfaces lie in a common plane. By doing so, a solenoid spacer 71 having an appropriate thickness can be chosen to provide a desired air gap between armature 62 and stator 61. Thus, solenoid spacer 71 is preferably a categorized part that comes in variety of slightly different thicknesses that allow different valves to perform similarly by choosing an appropriate thickness to provide uniformity in the armature air gap from one actuator to another.

In order to aid in concentrically aligning upper seat 50 with lower seat 51 along common centerline 38, valve member 42 includes an upper guide portion 54 with a close diametrical clearance (i.e. a guide clearance) with an upper guide bore 55 located in upper seat component 43. In addition, valve member 42 also preferably includes a lower guide portion 56 having a relatively close diametrical clearance with a lower guide bore 57 located in lower seat component 45. Thus, these guide regions tend to aid in concentrically aligning upper and lower seats 50 and 51 during the assembly of three way valve 14 as well as substantially fluidly isolating needle control chamber 37 from vented chamber 80 and/or armature cavity 82, regardless of the position of valve member 42. Because it is difficult to be certain, before assembly, the depth into seats 50 and 51 that valve member 42 will penetrate before coming in contact in closing that particular seat, three way valve 14 preferably employs a valve lift spacer 44 that is also a category part, and is preferably categorized in a plurality of different thickness groups. Thus, the distance that valve member 42 travels between upper and lower seats 50 and 51 is adjustable by choosing an appropriate thickness for valve lift spacer 44.

In order to reduce the influence of fluid flow forces on the movement of valve member 42, high pressure passage 40 and low pressure passage 41 preferably include flow restrictions 47 and 48, respectively, that are restrictive relative to a flow area across respective seats 50 and 51. While these flow restrictions could be located in upper seat component 43 and/or lower seat component 45, they are preferably located in valve lift spacer 44 as shown in FIG. 2. In particular, the flow characteristics through high pressure passage 40 can be relatively tightly controlled by including a cylindrical segment 47 having a predetermined length and flow area. Furthermore, cylindrical segment 47 is relatively restrictive to flow relative to that across upper seat 50. Those skilled in the art will appreciate that it is easier to control and consistently machine a flow characteristic via a cylindrical segment as opposed to attempting to consistently control a flow area between stationary seat component and moveable valve member 42. Likewise, low pressure passage 41 preferably includes a cylindrical segment 48 that is located in valve lift spacer 44. In order to differentiate the rate at which pressure changes can occur in needle control chamber 37, cylindrical segment 48 preferably has a different flow area relative to cylindrical segment 47. This feature is present in the illustrated example as a strategy by which the opening rate of the direct control needle valve is slowed relative to the closure rate of the same. In other words, when direct control needle valve 11 lifts toward its open position, fluid is displaced from needle control chamber 37 through the flow restriction defined by cylindrical segment 48. When direct control needle valve 11 is closed, high pressure fluid flows into needle control chamber 37 from high pressure passage 40 through the flow restriction defined by cylindrical segment 47. Since cylindrical segment 48 has a smaller flow area than cylindrical segment 47, in the illustrated embodiment, the opening rate of direct control needle valve 11 can be made slower than its closure rate, which is often desired.

In order to accommodate for the possibility of a slight angular misalignment between the centerline of valve member 42 and the respective centerlines of upper and lower seats 50 and 51, valve member 42 preferably includes spherical valve surfaces 52 and 53, which have a common center. Those skilled in the art will appreciate that spherical valve surfaces 52 and 53 can contact and close valve seats 50 and 51 even in the event of some minor angular misalignment between valve member 42 and its respective seats. In order to insure that the respective passageways, such as nozzle supply passage 24, provide the proper fluid connection as shown in FIG. 2, the stationary components of three way valve 14 preferably include dowel bores, which are present to prevent the valve from being misassembled. In order to hold three way valve 14 together, it preferably includes a plurality of fasteners that are threadably received in fastener bores located in upper seat component 43. Nevertheless, those skilled in the art will appreciate that numerous other strategies could be employed for clamping three way valve 14 together.

Figure 3:
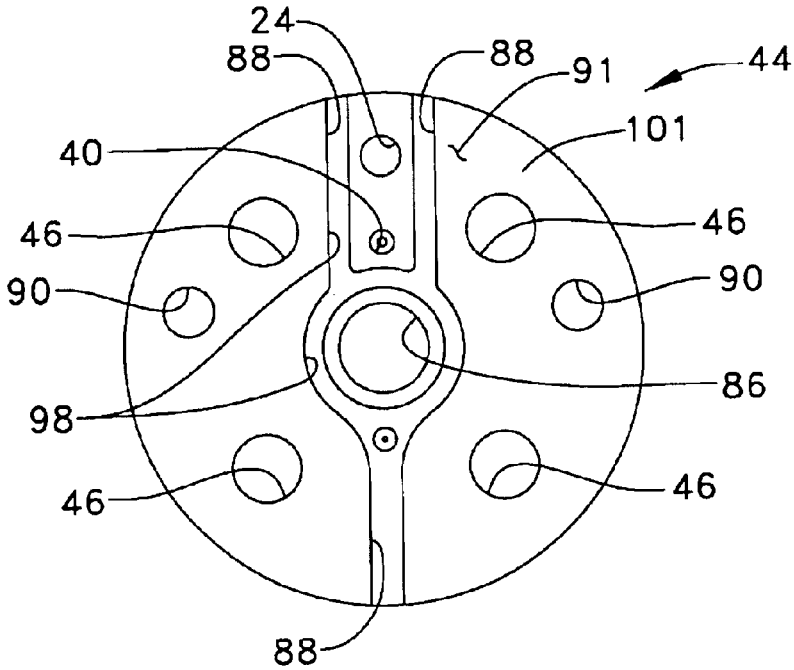
FIG. 3 is a top view of a valve lift spacer from the fuel injector of FIG. 1.
Figure 4:
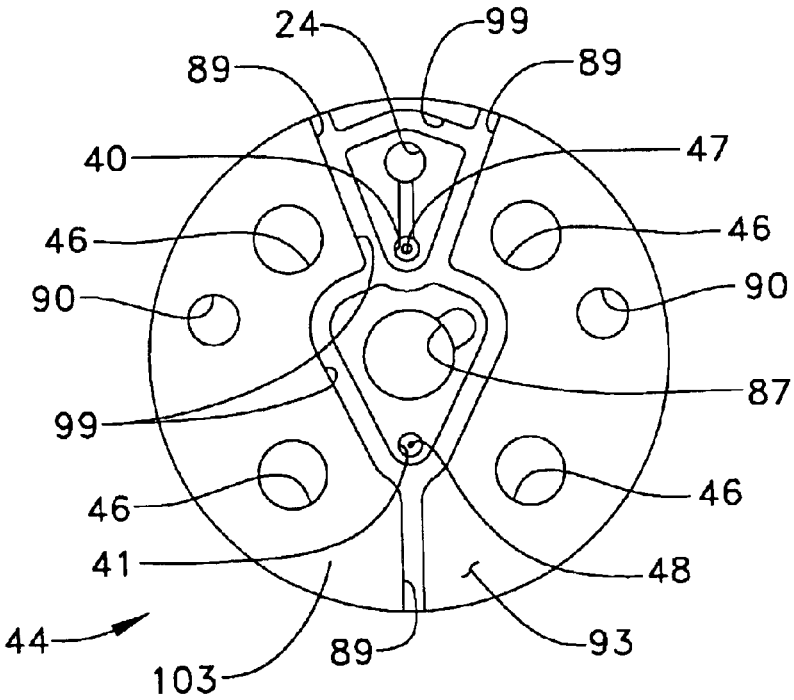
FIG. 4 is a bottom view of the valve lift spacer of FIG. 3.

Referring now in addition to FIGS. 3 and 4, valve lift spacer 44 includes leak arrest features to limit leakage between valve lift spacer 44 and upper and lower seat components 43 and 45. Valve lift spacer 44 includes four fastener bores 46 that allow valve 14 to be assembled. Proper alignment in the assembly of valve 14 is insured via the usage of dowels and dowel bores 90. Valve lift spacer 44 includes a first side 91 with a first planar surface 101 that creates a sealing land in contact with a second planar surface 102 of side 92 of upper seat component 43. When together as shown in FIGS. 1 and 2, components 43 and 44 could be considered a component sub-assembly 15 that defines a portion of control volume 85, which can also be considered a high pressure space when fuel pressure in the same is high. High pressure space 85 is bounded by a first perimeter 86, while the components themselves are bounded by a perimetrical side surface 96. In addition to control volume 85, components 43 and 44 also define a portion of nozzle supply passage 24 and high pressure passage 40, each of which could also be considered a high pressure space according to the present invention. In order to arrest the wedge affect of a potential leak, valve lift spacer 44 also includes a leak arrest volume 98 that encloses first perimeter 86 and is distributed around passages 24 and 40. Leak arrest volume 98 is vented to the low pressure space adjacent perimetrical side surface 96 inside injector casing via vent passage 88.

Those skilled in the art will appreciate that vent passages 88 may not be desirable in the case of some fuel injectors. For instance, vent passages 88 would likely be desirable for common rail applications in which the fuel injector is maintained at relatively high pressures for the long durations between injection events, but vent passages 88 could be omitted in the case of fuel injectors that are only cyclically at high pressures. Because valve lift spacer 44 is a relatively thin component, leak arrest volume 98 and vent passage(s) 88 can potentially be manufactured via a coining or stamping process at the blank stage. If vent passage(s) 88 are omitted, leak arrest volume 98 should have a sufficiently large volume that its pressure can be maintained below some predetermined level, but that pressure has the ability to decay between injection events when pressure is low.

Referring now to FIG. 4, valve lift spacer 44 also includes a third planar surface 103 of a third side 93 in contact with a fourth planar surface 104 of a fourth side 94 of lower seat component 45. These two components also define a portion of control volume 85 that is bounded at the sealing land by second perimeter 87. Like the opposite side of valve lift spacer 44, third side 93 includes a leak arrest volume 99 that is distributed to enclose second perimeter 87 and distributed to surround the other high pressure spaces defined by nozzle supply passage 24 and high pressure passage 40. In this embodiment, leak arrest volume 99 is vented to the low pressure space adjacent perimetrical side surface 96 via vent passage(s) 89. Those skilled in the art will appreciate that the leak arrest volumes are defined by the side surfaces of the two components so as to arrest any leakage that could develop in the sealing lands between the high pressure spaces and the leak arrest volume. Although the leak arrest volumes are shown as being defined by a planar surface of one component covering a groove in an opposing component, those skilled in the art will appreciate that the grooves could be formed in both components in order to form the leak arrest volume(s) of the present invention.

INDUSTRIAL APPLICABILITY

When fuel injector 10 is in operation, electro-hydraulic actuator 12 works in conjunction with direct control needle valve 11 to control both timing and quantity of each injection event. Each injection event is initialized by raising fuel pressure in high pressure source 18 to injection levels. In some systems, this is accomplished by maintaining a common rail at some desired pressure. Alternatively, source 18 can be a fuel pressurization chamber within a unit injector that is pressurized when a plunger is driven downward, which is usually accomplished with a cam or a hydraulic force. Because valve member 42 is biased downward to close low pressure seat 51, direct control needle valve 11 will stay in its downward closed position due to the high pressure force acting on closing hydraulic surface 33 of piston portion 32. Shortly before the timing at which the injection event is desired to start, electrical actuator 16 is preferably energized by supplying an excessive current to coil 60. Because the speed at which electrical actuator 16 operates is related to the current level supplied to coil 60, one preferably supplies the maximum available current, which can be substantially higher than an amount of current necessary to cause the armature to move against the action of the spring bias. When sufficient magnetic flux builds, armature 62 and valve member 42 are pulled upwards until spherical valve surface 52 contacts upper or high pressure seat 50. When this occurs, needle control chamber 37 is fluidly connected to low pressure fuel reservoir 20 via low pressure passage 41. Shortly before the desired end of an injection event, current to electrical actuator 16 is reduced or terminated to a level that allows spring 67 to push armature 62 and valve member 42 downward until spherical valve surface 53 comes in contact with low pressure seat 51. When this occurs, high pressure fluid originating in nozzle supply passage 24 flows through high pressure passage 40 past high pressure seat 50 and into needle control chamber 37. The high pressure force on piston 32 moves needle valve member 30 toward its closed position.

Like many fuel injectors, fuel injector 10 includes a plurality of stacked components 13 that need to be sealed against leakage at their various planar sealing land contact surfaces. In those areas where a potential leak could cause a component separation wedging affect, the present invention finds potential applicability. For instance, FIGS. 1 and 2 show valve lift spacer 44 and stop plate 75 as including leak arrest volumes that are distributed to surround high pressure spaces 37, 85, 40 and 24. If the application is a common rail fuel injector, these leak arrest volumes are preferably vented (such as by vent passages 88) to a low pressure space via an appropriate vent paths as described earlier. In the case of cyclic pressure fuel injectors, such as cam or hydraulically driven fuel injectors, vent paths could be omitted by making the leak arrest volume large enough to have the capacity to increase in pressure during an injection event below some pre-determined pressure, while also having the ability to have that pressure decay between injection events. Those skilled in the art might also find is desirable to include leak arrest volumes and vent paths between other components that seal against leakage of nozzle supply passage 24. In the illustrated embodiment, the leak arrest volumes and vent paths are preferably stamped or coined into valve lift spacer 44 and stop component 75. By including vent paths, the size of leak arrest volumes in the vent passages can be relatively loosely controlled since the volume of these spaces need not be tightly controlled. After being stamped, the planar surfaces of these components can be ground in a conventional manner.

The leak arrest volume should be distributed to sufficiently surround the high pressure perimeter that a wedging affect caused by a leak is prevented from causing substantial component separation which could lead to an even larger leakage. Although the leak arrest volumes preferably enclose the high pressure space in which they are sealing against leakage, they need not necessarily do so. For instance, passages 24 and 40 are not completely enclosed by leak arrest volume 98, but the leak arrest volume 98 is distributed to surround a majority of a perimeter around these passages.

The present invention is potentially advantageous in that leakage that exists between components can be limited by arresting a wedging affect that could cause even larger amounts of leakage. Those skilled in the art will appreciate that leakage is very undesirable in that it contributes to a number of undesirable affects, including energy wastage, altered injection amounts and variability among fuel injectors, among other potential problems. By appropriately locating leak arrest volumes according to the present invention, any leakage that does start to occur between components is prevented from substantially exacerbating into a large leak by connecting the leak to a low pressure space long before it reaches the perimetrical outer side surface that surrounds the two components. Alternatively, if the high pressure space is near the outer side surface of the components (FIG. 3, passage 24), then it may not be desirable to insert a leak arrest volume between the higher pressure space and the outer side surface of the component (s).

Although the present invention has been illustrated in the context of a fuel injector, those skilled in the art will appreciate that the concept of the present invention could find potential application in any component sub-assembly that includes a planar sealing land that is intended to prevent leakage from a high pressure space within the components.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A component subassembly comprising:

a first component having a first side with a first planar surface;

a second component having a second side with a second planar surface in contact with said first planar surface;

said first and second components defining a high pressure space that passes through said first and second planar surfaces at a perimeter;

said first side and said second side defining at least one leak arrest volume distributed to surround at least a majority of said perimeter;

said first and second components together include a perimetrical side surface surrounding said high pressure space and said leak arrest volume; and wherein at least one of said first and second components defines a vent passage extending between said leak arrest volume and said side surface.

2. The subassembly of claim 1 including a third component having a fourth side with a fourth planar surface;

said first component including a third side with a third planar surface in contact with said fourth planar surface;

said perimeter is a first perimeter, and said high pressure space passes through said third planar surface and said fourth planar surface at a second perimeter; and said third side and said fourth side define at least one leak arrest volume distributed to surround at least a majority of said second perimeter.

3. The subassembly of claim 1 wherein said leak arrest volume surrounds said perimeter.

4. The subassembly of claim 3 wherein said leak arrest volume encloses said perimeter.

5. The subassembly of claim 1 wherein said first and second components define a plurality of high pressure spaces that pass through said first and second planar surfaces; and said first side and said second side defining at least one leak arrest volume distributed to surround at least a majority of said high pressure spaces.

6. The subassembly of claim 1 including a valve member extending into said high pressure space.

7. A fuel injector comprising:

a plurality of stacked components that include a first component and a second component;

said first component having a first side with a first planar surface;

said second component having a second side with a second planar surface in contact with said first planar surface;

said first and second components defining a high pressure space that passes through said first and second planar surfaces at a perimeter;

said first side and said second side defining at least one leak arrest volume distributed to surround at least a majority of said perimeter;

a control valve member operably coupled to an electrical actuator;

said control valve member extends into said high pressure space;

at least one of said first and second components includes a valve seat;

said valve member being biased toward a position in contact with said valve seat when said electrical actuator is energized;

a third component having a fourth side with a fourth planar surface;

said first component including a third side with a third planar surface in contact with said fourth planar surface;

said perimeter is a first perimeter, and said high pressure space passes through said third planar surface and said fourth planar surface at a second perimeter; and said third side and said fourth side define at least one leak arrest volume distributed to surround at least a majority of said second perimeter.

said valve seat is a first valve seat, and said second and third components include said first valve seat and a second valve seats, respectively; and said control valve member being trapped to move between said first and second valve seats.

8. The fuel injector of claim 7 wherein said first and second components together include a perimetrical side surface surrounding said high pressure space and said leak arrest volume; and at least one of said first and second components defines a vent passage extending between said leak arrest volume and said side surface.

9. The fuel injector of claim 8 wherein said leak arrest volume encloses said perimeter.

10. A valve comprising:

an upper seat component with a first valve seat and a second planar surface;

a valve lift spacer with a first planar surface in contact with said second planar surface, and including a third planar surface;

a lower seat component with a second valve seat and a fourth planar surface in contact with said third planar surface;

a valve member trapped to move between said first valve seat and said second valve seat;

said upper seat component, said valve lift spacer and said lower seat component defining at least one high pressure space and at least one leak arrest volume at least partially surrounding said high pressure space.

11. The valve of claim 10 wherein at least one of said upper seat component, said valve lift spacer and said lower seat component define a vent passage extending between said leak arrest volume and a location outside said upper seat component, said valve lift spacer and said lower seat component.

12. The valve of claim 10 wherein said leak arrest volume completely surrounds said high pressure space.

13. The valve of claim 10 wherein said valve member has a first position in contact with said first valve seat, and a second position in contact with said second valve seat;

a first passage being open to a second passage but closed to a third passage when said valve member is in said first position; and said first passage being closed to said second passage but open to said third passage when said valve member is in said second position.

14. The valve of claim 13 wherein segments of said first passage, said second passage and said third passage pass through said valve lift spacer.

15. The valve of claim 10 wherein said valve member has an upper guide portion guided in a guide bore defined by said upper seat component; and said valve member has a lower guide portion guided in a guide bore defined by said lower seat component.

* * * * *